US006751891B2

(12) United States Patent
Lombardino

(10) Patent No.: US 6,751,891 B2
(45) **Date of Patent: *Jun. 22, 2004**

(54) ARTICLE OF FOOTWEAR INCORPORATING A SHOCK ABSORPTION AND ENERGY RETURN ASSEMBLY FOR SHOES

(76) Inventor: Thomas D Lombardino, 82-11 160$^{TH}$ Ave., Howard Beach, NY (US) 11414

( * ) Notice: Subject to any disclaimer, the term of this patent is extended or adjusted under 35 U.S.C. 154(b) by 0 days.

This patent is subject to a terminal disclaimer.

(21) Appl. No.: 09/947,587

(22) Filed: Sep. 7, 2001

(65) Prior Publication Data

US 2002/0073579 A1 Jun. 20, 2002

Related U.S. Application Data

(63) Continuation-in-part of application No. 09/528,728, filed on Mar. 20, 2000, now abandoned, which is a continuation-in-part of application No. 09/303,087, filed on Apr. 29, 1999, now Pat. No. 6,055,747.

(51) Int. Cl.[7] ..... A43B 21/32

(52) U.S. Cl. ..... 36/28; 36/27; 36/37; 36/142; 36/38

(58) Field of Search ..... 36/27, 28, 37, 36/38, 35 R, 142, 143, 144

(56) References Cited

U.S. PATENT DOCUMENTS 2,632,964 A * 3/1953 Kriegel ..... 36/37
2,669,038 A * 2/1954 De Werth ..... 36/38
2,721,400 A * 10/1955 Israel ..... 36/169
5,224,278 A * 7/1993 Jeon ..... 36/29
5,502,901 A * 4/1996 Brown ..... 36/28
5,544,431 A * 8/1996 Dixon ..... 36/38
5,649,374 A * 7/1997 Chou ..... 36/27
5,743,028 A * 4/1998 Lombardino ..... 36/27
6,006,449 A * 12/1999 Orlowski et al. ..... 36/27
6,055,747 A * 5/2000 Lombardino ..... 36/37
6,115,943 A * 9/2000 Gyr ..... 36/35 R

* cited by examiner

*Primary Examiner*—M. D. Patterson

(57) ABSTRACT

A shock absorption and energy return assembly for increasing the stability, shock absorption and energy return capabilities of a shoe. The assembly generally includes lower and upper guide members having a plurality of spring retainers, a plurality of springs positioned within the spring retainers, and a resilient connecting member which fixedly attaches the lower guide member to the upper guide member and serves to limit the separation between the guide members, preventing disengagement of the springs from within the guide members while simultaneously providing a means of allowing the springs to compress below their uncompressed height when a force is applied on the assembly. Alternatively, the assembly could be surrounded by a sealed, transparent encasement, which in one embodiment would comprise a lower portion and an upper portion surrounding the lower guide member and the upper guide member, and a plurality of lower extrusions and upper extrusions. The extrusions would extend into a plurality of apertures contained within the guide members as well as the plurality of compression springs positioned between the guide members, and would be adjoined. The encasement may also be filled with a pressurized gas for added stability and dampening of the springs. The inventive device is designed to be inserted or molded within the heel or forefoot portion of the mid-sole of a shoe, with the mid-sole optionally having one or more cutouts, thereby allowing a means of viewing the inventive device in operation.

15 Claims, 12 Drawing Sheets

16
20
70
12
14
50

40
28
26
20
50
30
24
70
22

70
50
4
4
20
14
40
42
44

16
28
44
40
40
26
26
28
20
70
50
50
30
22
34
24
12
14
70
22
24
30
14

16
26
28
40
20
70
50
30
22
24
12
14

20
50
42
44
40
60
70
10
10

40
50
28
40
72
20
70
30
60
24
30

ARTICLE OF FOOTWEAR INCORPORATING A SHOCK ABSORPTION AND ENERGY RETURN ASSEMBLY FOR SHOES

CROSS REFERENCE TO RELATED PATENT APPLICATION

This application is a continuation-in-part of U.S. patent application 09/528,728 filed on Mar. 20, 2000, now abandoned, which is a continuation-in-part of application Ser. No. 09/303,087, filed on Apr. 29, 1999, now U.S. Pat. No. 6,055,747.

BACKGROUND OF THE INVENTION

1. Field of the Invention

The present invention relates generally to footwear cushion devices and more specifically it relates to a shock absorption and energy return assembly for increasing the overall performance of a shoe by increasing its stability, shock absorption and energy return capabilities.

Footwear, such as athletic shoes, are utilized by millions of individuals throughout the world. Athletic shoes are utilized in sports such as basketball, soccer, baseball, volleyball, track and football. When utilized in extreme environments such as athletic shoes are often utilized in, significant stress is placed upon the user's bones and joints throughout their entire body, eventually leading to serious injury to the user. Hence, there is a need for a shoe that reduces the amount of shock received by the user. Additionally, there is a need for a shoe that enhances an athletes performance by returning a portion of the energy applied to the footwear back to the user.

2. Description of the Prior Art

Footwear cushion devices have been in use for years. Typically, footwear includes a rubber sole, a mid-sole attached to the rubber sole, and an upper. The upper is generally constructed of leather or similar material. The mid-sole is generally constructed of a resilient foamed polyurethane type material for cushioning the user's foot during use. The mid-sole, particularly in the rear portion, will often times have a reticulated structure for providing increased flexibility and resilience. Some brands of footwear include a pressurized bag located in the heel portion for providing increased cushioning during utilization.

While these devices may be suitable for the purpose of cushioning a shoe, they are not as suitable for increasing the overall performance of a shoe by increasing the stability and energy return properties of the footwear. There are several prior art shoes that attempt to address the objectives achieved by the instant invention herein disclosed. However, most of these prior art references fail in practicality, commercial feasibility, and in some cases, general principal. Even in the case where the prior art can be manufactured to function, the function achieved would be inferior, and the costs and complexity to produce them substantial, in relation to the instant invention.

Specifically, U.S. Pat. No. 5,671,552 discloses springs within the forefoot portion of an athletic shoe. Additionally, the shoe contains an air bladder and air passage that is designed to allow air to travel in an out of the air bladder. This patent teaches no way of retaining the springs in a controlled manner within the footwear.

U.S. Pat. No. 5,513,448 discloses a removable, sealed insole cassette containing springs. The cassette is made of a resiliently flexible encasement additionally serving as a method of retaining the said springs. This configuration, while providing a means of retaining the springs, will not provide adequate function since the resilient nature of the encasement will not provide the necessary torsional stability required of an athletic shoe. It is also evident from the disclosure as well as the overall design, that the device is meant exclusively as a cushioning aid, since the resilient cassette is the primary feature of the device and would limit the capability of the enclosed compression springs from providing a means of returning any substantial portion of energy applied.

U.S. Pat. No. 5,544,431 discloses removable springs in conjunction with a foam insert placed within an aperture of a mid-sole. As in the U.S. Pat. No. 5,671,552, this patent also does not teach a way of physically retaining the springs in a controlled manner within the mid-sole.

U.S. Pat. No. 5,918,383 discloses an insert containing a plurality of elastically deformable interconnected polygonal elements. This is the only patent of the referenced group that is produced commercially. Fila USA refers to it as the 2A System. This system does not disclose or imply the use of traditional spring elements and provides minimal, if any, energy return capabilities. Also, as in the U.S. Pat. No. 5,513,448, this design does not disclose a method of providing torsional stability.

U.S. Pat. No. 5,224,278 discloses an air bag containing a plurality of spring chambers and an air pressure adjustment means. While this patent does teach a way of retaining the springs in a spaced relationship within the airbag, this patent differs substantially in form and function from the instant invention in that it does not provide any guide members for the purpose of allowing the springs to function in tandem, or to provide lateral or torsional stability. Also, similar to the U.S. Pat. No. 5,513,448, the airbag is the primary means of retaining the springs. When inflated with the necessary air pressure to maintain stability of the airbag, the enclosed compression springs would be dampened to a point whereas they could not return any substantial portion of energy applied.

U.S. Pat. No. 5,502,901 discloses a footwear assembly comprising springs and opposing magnets. In the illustrated configuration, it is highly unlikely that the device could be produced. Because of the overall complexity and bulk of the disclosed device, even if production were possible, its functional capabilities would be inferior, and the costs and complexity to produce it substantial, in relation to the instant invention.

U.S. Pat. No. 5,649,374 shows a spring assembly contained within a transparent retaining bracket made of an undisclosed hard material. This configuration provides no resiliency to the assembly, and therefore prevents the device from providing any energy return capabilities. Additionally, even if a more resilient material were to be used to house the assembly, the reference does not disclose a method, nor is one readily apparent from reviewing the specification, of being able to substantially secure the assembly within the mid-sole and the upper portion of the shoe.

Lastly, U.S. Pat. No. 2,669,038 discloses an early adaptation of a shock absorbing heel. While innovative for the period, the obvious drawbacks of the mechanism are that it is complex, bulky and would have been very labor intensive to produce. Additionally, the mechanism functions in a different manner, and with markedly different results, than that disclosed by the instant invention. In the disclosed configurations, the device requires substantially more components and additional manufacturing processes in order to achieve its desired function. Even if more modern day materials and techniques were to be implemented into the design, the device would still not achieve a similar function or appearance to that of the instant invention without departing from the scope of the patents claims.

In respect to the aforementioned prior art, the shock absorption and energy return assembly for shoes according to the present invention substantially departs from these and other conventional concepts and designs, and in so doing provides an apparatus primarily developed for the purpose of increasing the overall performance of a shoe by increasing its stability, shock absorption and energy return capabilities in a safe, durable, cost effective, and commercially viable manner.

SUMMARY OF THE INVENTION

In view of the foregoing disadvantages inherent in the known types of footwear cushion devices now present in the prior art, the present invention provides a new shock absorption and energy return assembly for shoes construction wherein the same can be utilized for increasing the overall performance of a shoe by increasing the stability, shock absorption, and energy return properties of the footwear at the heel and forefoot section.

The general purpose of the present invention, which will be described subsequently in greater detail, is to provide a new shock absorption and energy return assembly for shoes that has many of the advantages of the footwear cushion devices mentioned heretofore and many novel features that result in a new shock absorption and energy return assembly for shoes which is not anticipated, rendered obvious, suggested, or even implied by any of the prior art footwear cushion devices, either alone or in any combination thereof.

To attain this, one embodiment of the present invention generally comprises lower and upper guide members having a plurality of spring retainers, a plurality of springs positioned within the spring retainers, and a resilient connecting member which fixedly attaches the lower guide member to the upper guide member and serves to limit the separation between the guide members, preventing disengagement of the springs from within the guide members while simultaneously providing a means of allowing the springs to compress below their uncompressed height when a force is applied on the assembly.

In a further embodiment, the footwear comprises a forward shock absorption and energy return assembly situated at a point beneath the ball of the foot, and a rear shock absorption and energy return assembly situated at a point beneath the heel of the foot. Each assembly comprises a resiliently strong upper guide member having a plurality of spring retainers, a resiliently strong lower guide member having a plurality of spring retainers, and a plurality of compression springs positioned within the guide members, with a resilient connecting member fixedly attached between the guide members. Additionally, the lower guide members are integrally attached by a medial connecting member.

In yet a further embodiment, the springs positioned at an inside portion of the sagittal plane of the assembly are of a different spring rate than the springs of the outside portion, providing for a means of pronation control to the footwear. Conversely, the springs positioned at an outside portion of the sagittal plane of the assembly could be of a differing spring rate than the springs of the inside portion, providing for a means of supination control to the footwear.

In another embodiment, the assembly could be surrounded by a sealed, transparent encasement, which would comprise a lower portion and an upper portion surrounding the lower guide member and the upper guide member, and a plurality of lower extrusions and upper extrusions. The extrusions would extend into a plurality of apertures contained within the guide members as well as the plurality of compression springs positioned between the guide members, and would be adjoined. The encasement could be filled with a pressurized gas for added stability and dampening of the springs.

In all embodiments, the inventive allows great manufacturing versatility in that it can be inserted and bonded into the mid-sole in a pre-formed cut-out, or optionally, it can be molded within the mid-sole during the mid-sole manufacturing process. It can be situated at the heel portion, the forefoot portion, or both portions of the mid-sole of a shoe, with the mid-sole optionally having one or more openings to allow a means of viewing the inventive device in operation.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a shock absorption and energy return assembly for shoes that will overcome the short comings of the prior art devices.

An more specific primary objective is to provide a shock absorption and energy return assembly for shoes that efficiently receives and substantially returns forces incurred by the shoe.

Another objective is to provide a shock absorption and energy return assembly for shoes that absorbs a substantial amount of the force incurred by the shoe.

A further object is to provide a shock absorption and energy return assembly for shoes that provides significant lateral stability to the shoe.

An additional object is to provide a shock absorption and energy return assembly for shoes that can be specifically tuned to effectively address pronation or supination inefficiencies by way of varying the spring rates at specific regions within the assembly.

Another object is to provide a shock absorption and energy return assembly for shoes that can be manufactured into a singular enclosed unit.

A further object is to provide a shock absorption and energy return assembly for shoes that utilizes springs for receiving and releasing energy from and into the shoe.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTIONS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

Figure 14:
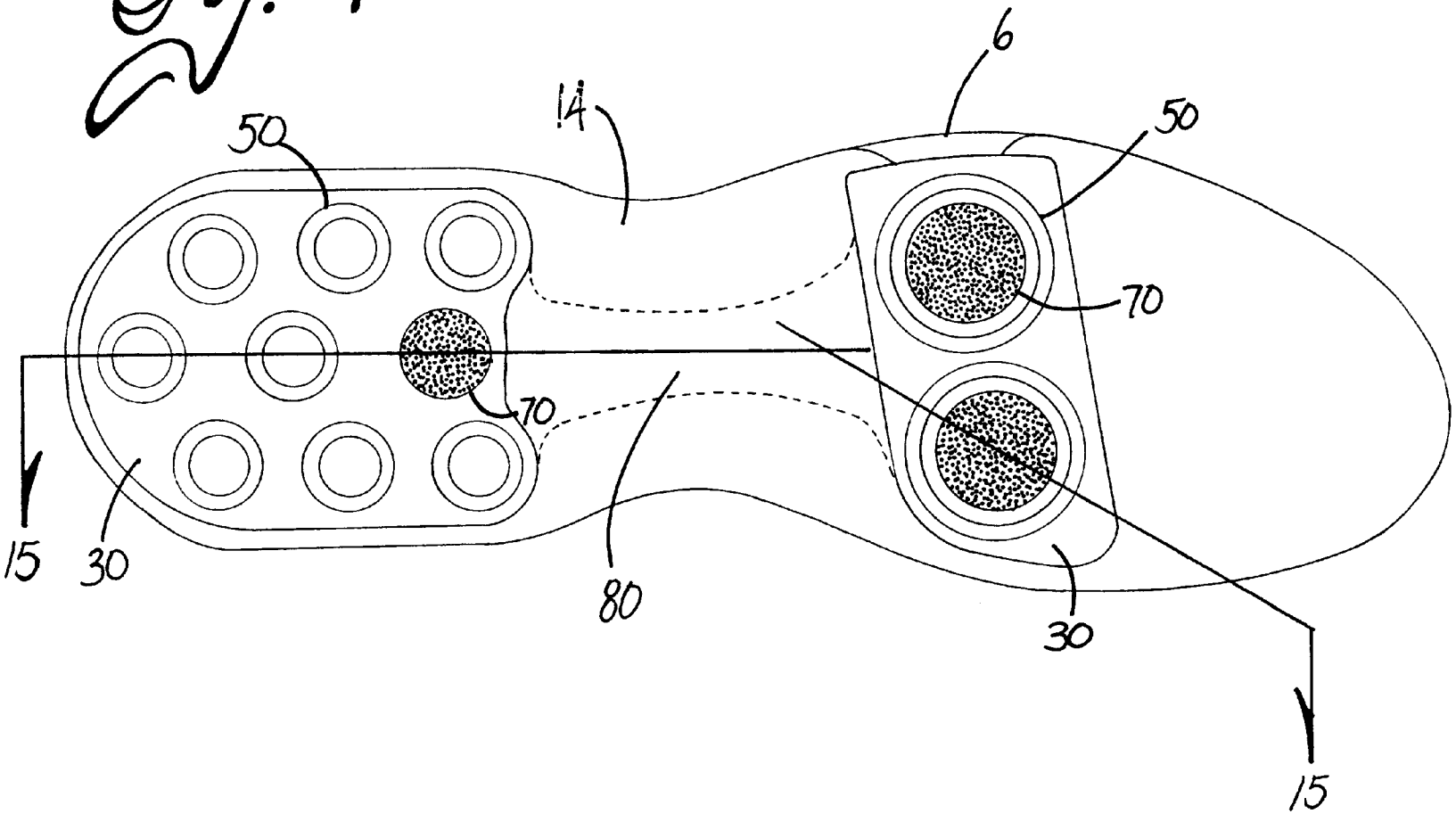
Figure 15:
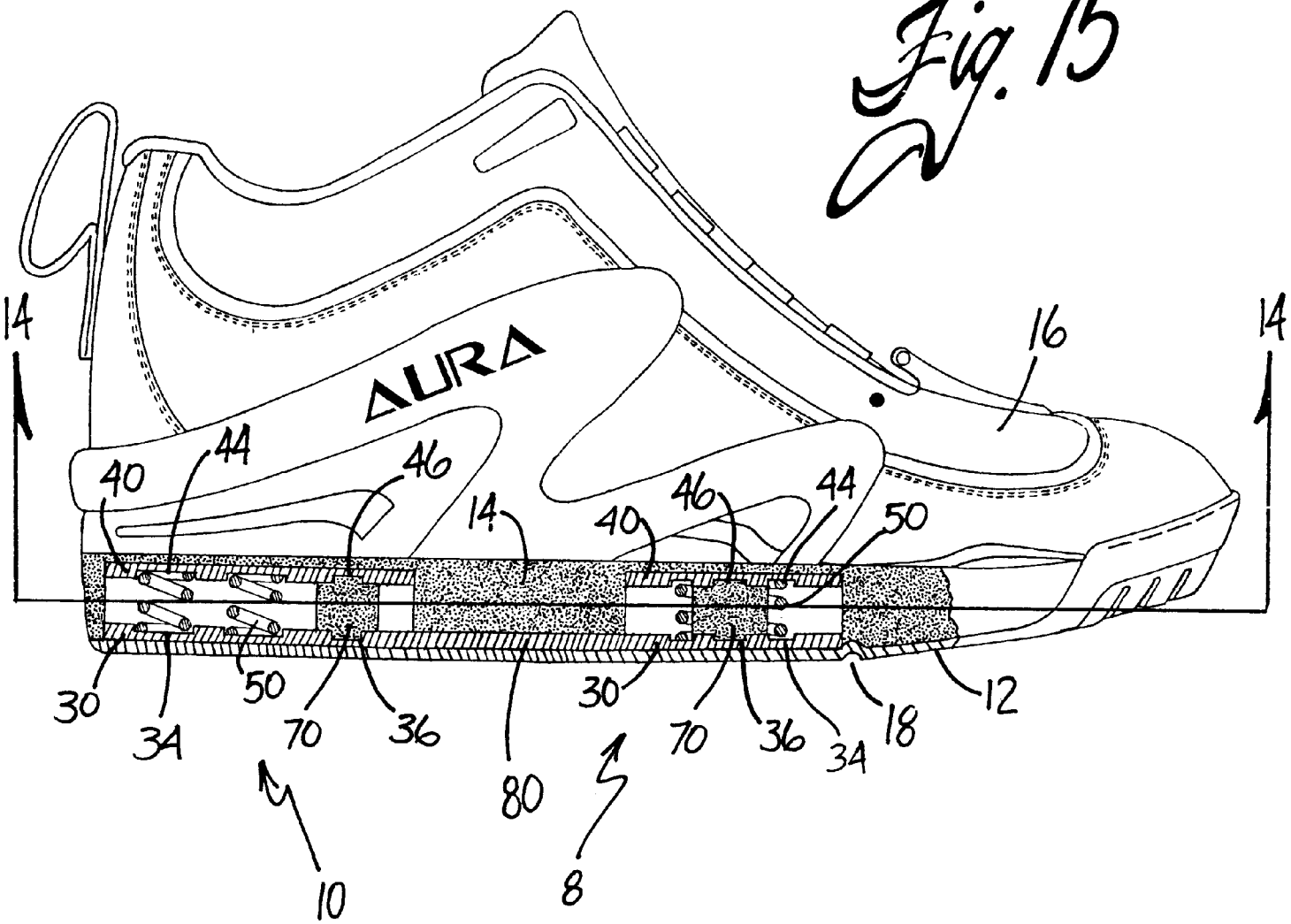

FIG. 14 is a top view of an alternative full length embodiment of the present invention within a mid-sole taken along line 14—14 of FIG. 15. This configuration includes a forward assembly comprising a lower guide member and a rear assembly comprising a lower guide member, whereas the lower guide members of the forward and rear assemblies are integrally attached by a medial connecting member. The medial connecting member further serves as a support shank, providing additional lateral and torsional stability to the footwear.

FIG. 15 is a cross sectional view taken along line 15—15 of FIG. 14, which shows a forward assembly comprising a lower guide member and a rear assembly comprising a lower guide member, whereas the lower guide members of the forward and rear assemblies are integrally attached by a medial connecting member.

Figure 16:
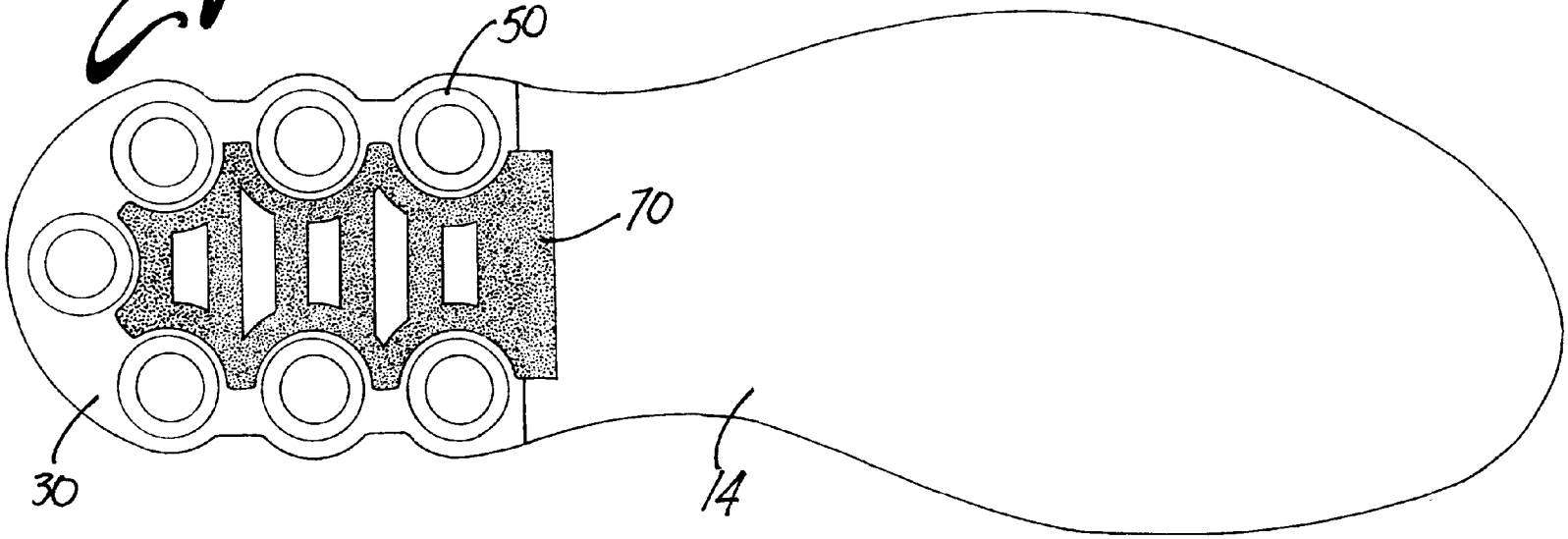

FIG. 16 is an additional cross sectional view showing an alternative resilient connecting member and lower guide member configuration.

DESCRIPTION OF THE PREFERRED EMBODIMENT

In all embodiments of the present invention, the general principal of its function is the same. The user positions their foot within each shoe. When the user steps, the heel absorbs the initial shock of the user's body weight at the rear lateral portion. As the foot pronates, it begins to roll anteriorly and medially throughout the length of the footwear. The impact absorbed at the heel portion is immediately and substantially returned back to the user as energy, increasing the power produced throughout the stride up until the time the foot leaves the ground at toe off. In applications containing an embodiment of the present invention additionally in the forefoot portion, the energy return effect is further improved by transferring the energy returned from the heel of the footwear to a more powerful instep at the forefoot. The initial shock is again absorbed anteriorly and medially, and a substantial amount of energy is returned from the area at the ball of the foot, increasing the power achieved by the user at toe off. The energy return effects are substantially achieved by the contraction and resultant expansion of the compression springs 50 which provides an opposite force to lift the user's foot.

Figure 1:
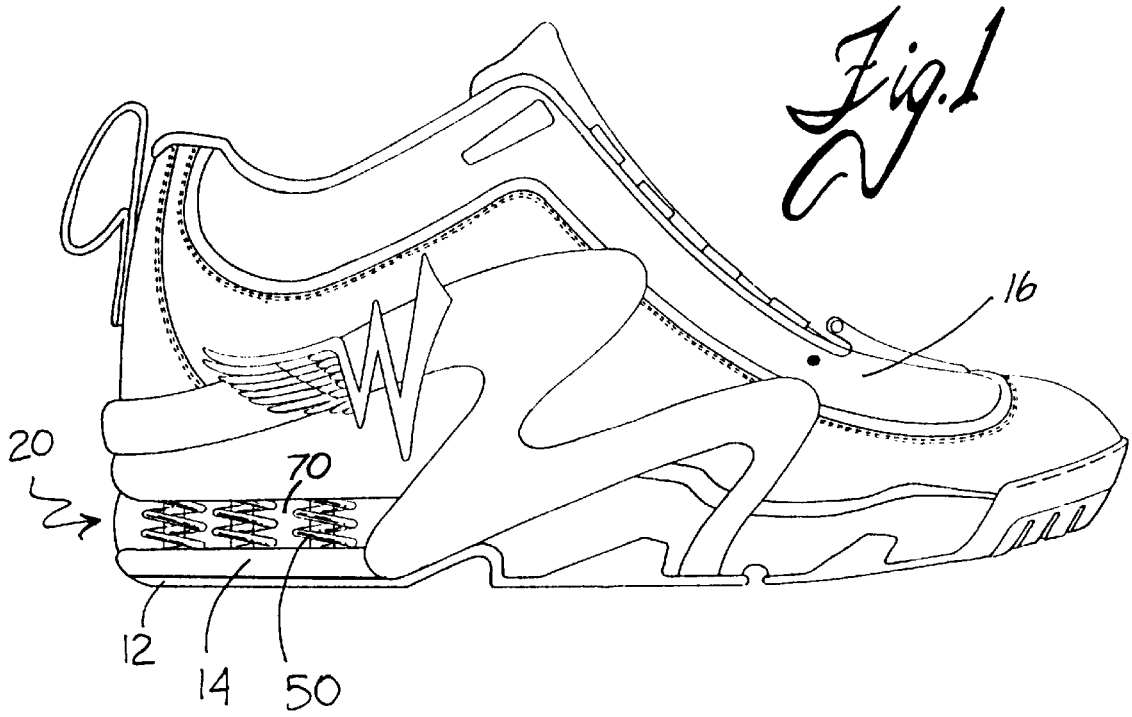
FIG. 1 is a side view of one embodiment of the present invention within a shoe.
Figure 2:
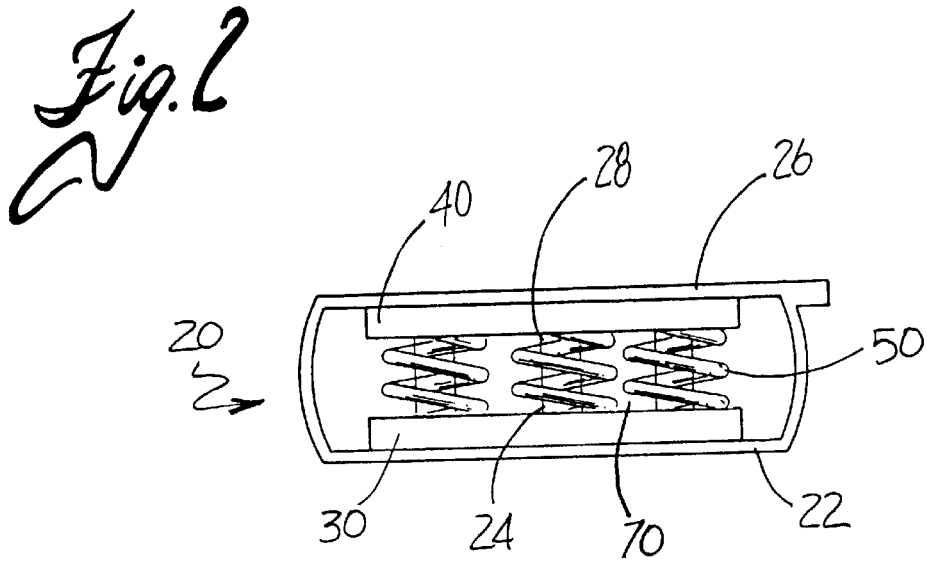
FIG. 2 is a side view of the same embodiment of the present invention.

Turning now descriptively to the drawings, in which similar reference characters denote similar elements throughout the several views, FIG. 1 illustrates a shock absorption and energy return assembly for shoes 10, which comprises a lower guide member 30 having a plurality of lower apertures 32 and lower spring retainers 34, a resilient connecting member 70, an upper guide member 40 having a plurality of upper apertures 42 and upper spring retainers 44, a plurality of compression springs 50 positioned within the lower spring retainers 34 and the upper spring retainers 44, a sealed encasement 20 having a lower portion 22 and an upper portion 26 surrounding the lower guide member 30 and the upper guide member 40, and a plurality of lower extrusions 24 and upper extrusions 28. The lower guide member 30 and the upper guide member 40 are fixedly attached to one another by way of a resilient connecting member 70 that is positioned between the guide members 30, 40 and held in place by an adhesive or other fastening means. The plurality of compression springs 50 are aligned within the perimeter of the lower guide member 30 and the upper guide member 40 for providing maximum stability and response for the user. The encasement can be filled with a pressurized gas for adding stability and dampening of the compression springs 50, depending on the desired use of the shoe. The inventive device is designed to be inserted or molded within the heel portion of the mid-sole 14 of a shoe. The encasement 20 is preferably constructed of a transparent or semi-transparent material utilized in combination with a cutout 6 within the mid-sole 14 thereby allowing individuals to view the inventive device in operation.

Conventional shoes generally comprise a lower sole 12, a mid-sole 14 and an upper 16. The lower sole 12 is generally constructed of a rubber material and has a gripping portion on the lower surface of the lower sole 12. The mid-sole 14 is attached to the lower sole 12 by stitching or adhesive and is generally constructed of a resilient foam rubber material. The upper 16 is generally constructed of leather or synthetic leather material.

Figure 6:
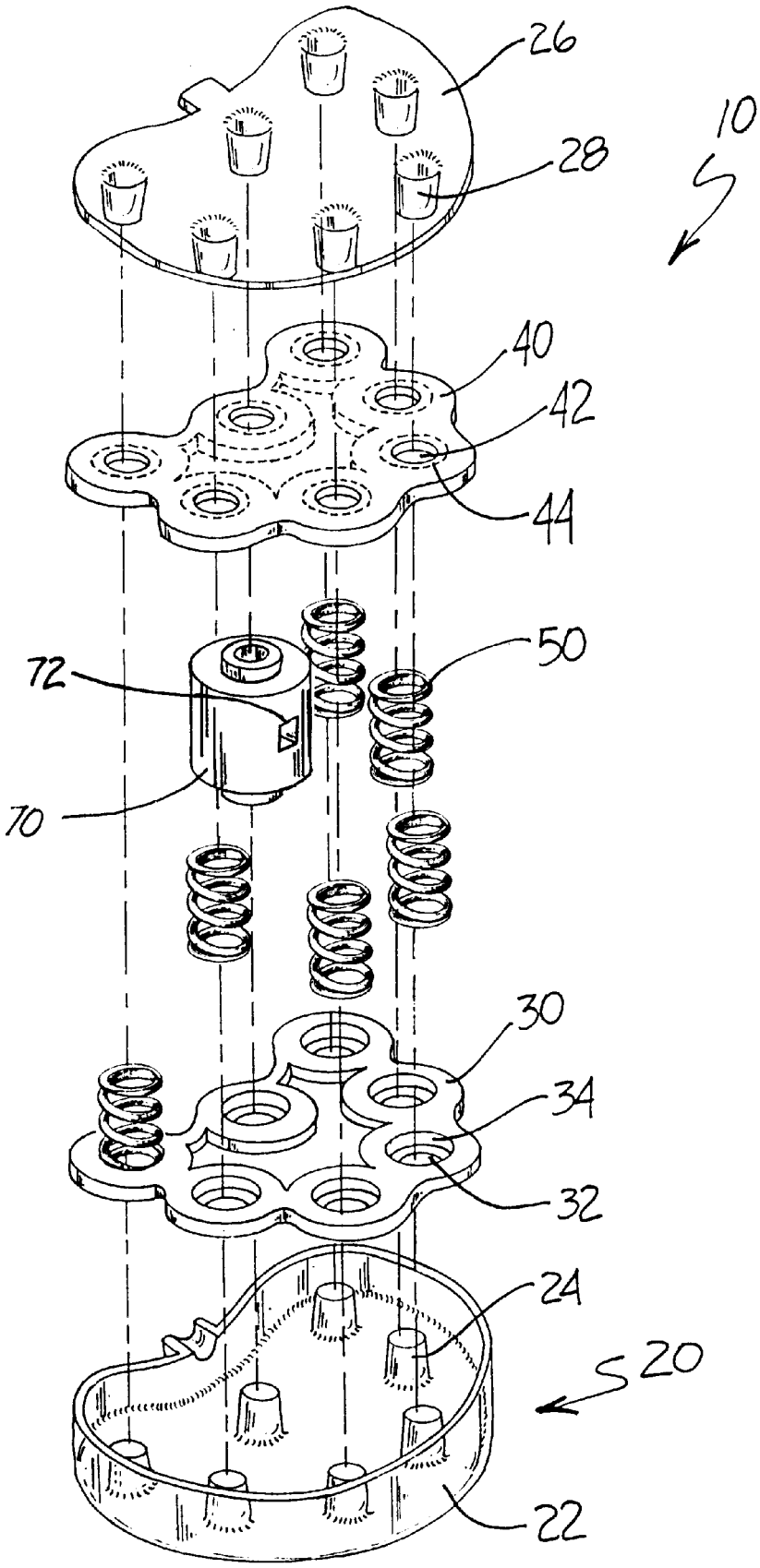
FIG. 6 is an exploded upper perspective view of the present invention, showing the use of the resilient connecting member as previously shown in FIG. 3.

As shown in FIG. 6 of the drawings, the encasement 20 is comprised of a substantially U-shaped structure for fitting within the heel portion of the mid-sole 14. The encasement 20 is preferably constructed of a resilient transparent or semi-transparent material. The encasement 20 is preferably constructed of a sealed and impermeable polyurethane material.

Figure 3:
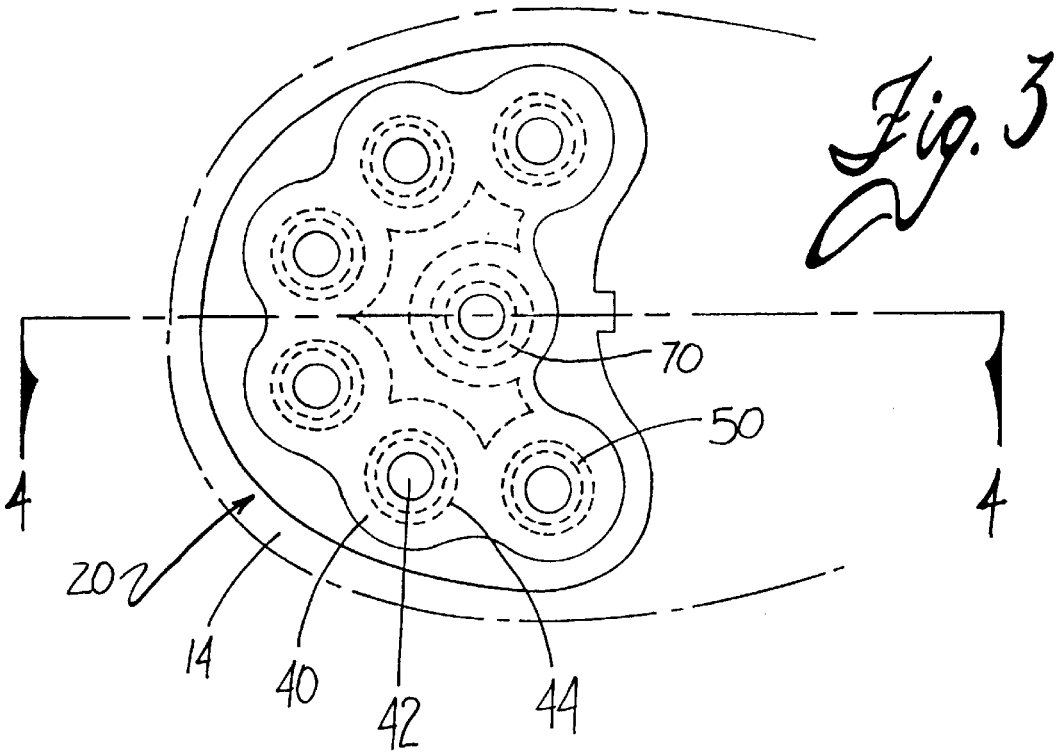
FIG. 3 is an top view showing an alternative embodiment using a resilient connecting member in place of a spring.
Figure 7:
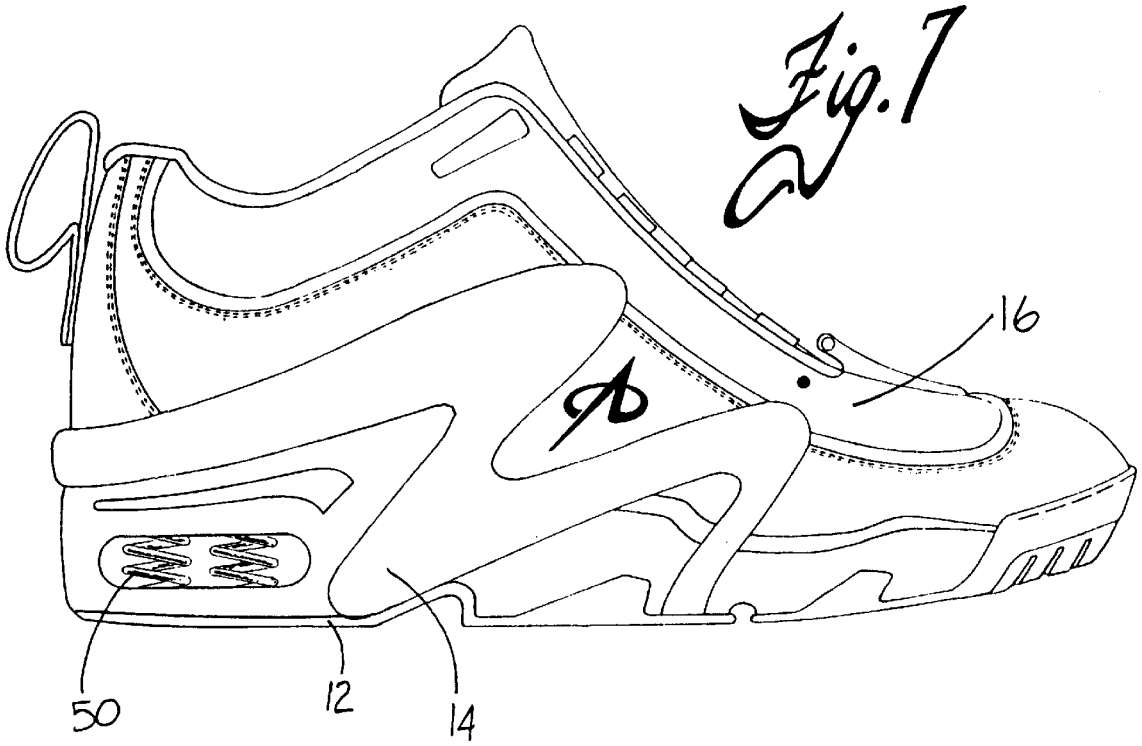
FIG. 7 is an alternative embodiment of the present invention within the mid-sole of a shoe without the sealed encasement.
Figure 8:
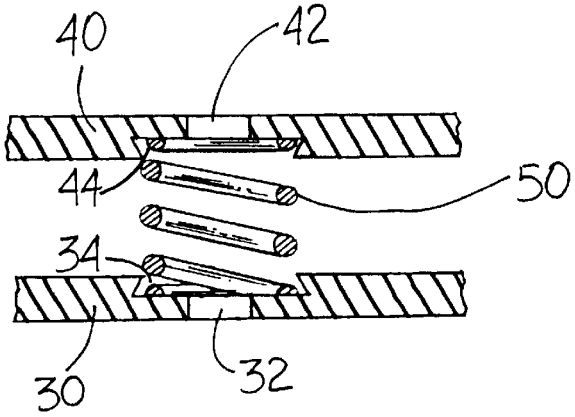
FIG. 8 is a cross sectional view of the spring housing taken along line 4—4 of FIG. 3 better illustrating the spring retainers of the upper and lower guide members.

As best shown in FIG. 6, the encasement 20 is preferably comprised of a lower portion 22 and an upper portion 26. The lower portion 22 of the encasement 20 has a floor and a side wall surrounding the entire perimeter of the floor. The floor preferably has a U-shape as shown in FIGS. 3 and 7 of the drawings.

Figure 10:
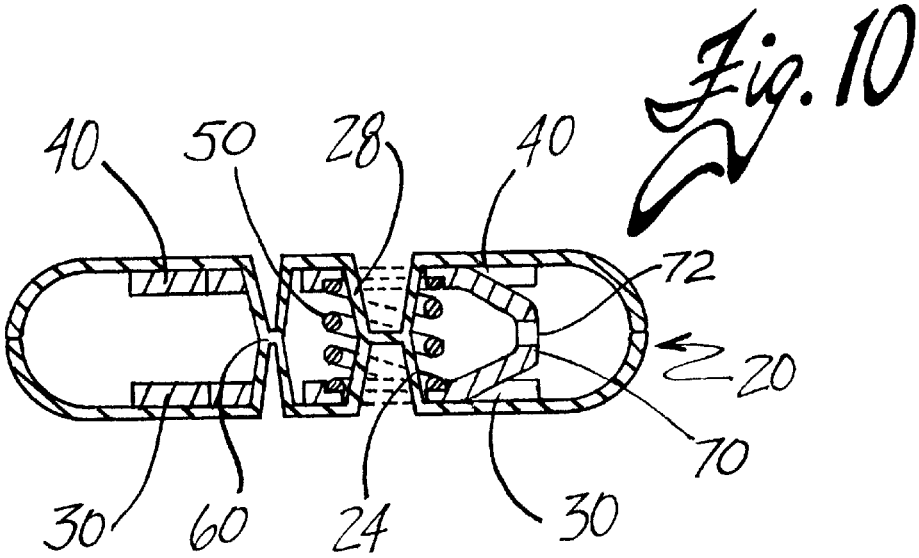
FIG. 10 is a cross sectional view taken along line 10—10 of FIG. 9.

As best shown in FIG. 6 of the drawings, the upper portion 26 is generally a flat structure that is shaped substantially the same as the floor of the lower portion 22. The perimeter of the upper portion 26 is attached and sealed to the upper portion 26 of the side wall of the lower portion 22 as shown in FIG. 6 of the drawings. The upper portion 26 may be sealed with the lower portion 22 by any well-known means such as a hermetically sealing process or chemical sealing. Alternatively, as shown in FIG. 10, the upper portion 26 would be of identical shape and form to the lower portion 22, with both portions 26, 22 meeting at a central axis and being sealed in a manner as previously described.

If desired, a pressurized gas may be inserted into the sealed encasement 20 for providing increased stability and absorption in combination with the plurality of compression springs 50. The pressurized gas may be comprised of an inert gas such as Argon or Krypton, providing for reduced diffusion rates of the gas from within the sealed encasement 20, however ambient air pressure can also be utilized. The pressurized gas may have a pressure of 0–25 psi depending on the designed use of the shoe. The more pressure within the sealed encasement 20 the more dampening and shock absorption received within the shoe. With less pressure within the sealed encasement 20, the compression springs 50 contract and expand further, thereby providing more energy return to the user.

As best shown in FIG. 6 of the drawings, a plurality of lower extrusions 24 extend from the floor of the lower portion 22. The lower extrusions 24 extend upwardly near the side wall of the lower portion 22 for inserting through the lower guide member 30 and the plurality of compression springs 50. The lower extrusions 24 preferably have a slight taper from the floor of the lower portion 22. The lower extrusions 24 are preferably molded within the floor of the lower portion 22, however it can be appreciated that they can be attached to the floor. The lower extrusions 24 are connected to the upper extrusions 28 as shown in FIG. 10 of the drawings.

As further shown in FIG. 6 of the drawings, a plurality of upper extrusions 28 extend from the upper portion 26. The upper extrusions 28 extend downwardly from the upper portion 26 for inserting through the upper guide member 40 and the plurality of compression springs 50. The upper extrusions 28 preferably have a slight taper as best shown in FIG. 7 of the drawings. The upper extrusions 28 are preferably molded within the upper portion 26, however it can be appreciated that they can be attached to the upper portion 26 after being molded. As shown in FIG. 10 of the drawings, the upper extrusions 28 are preferably connected to the lower extrusions 24 for various reasons such as support and for preventing the encasement 20 from over-expanding when pressurized. The extrusions 28, 24 are further designed to be easily deformable upon impact, thereby allowing the compression springs 50 to contract and expand freely.

Figure 9:
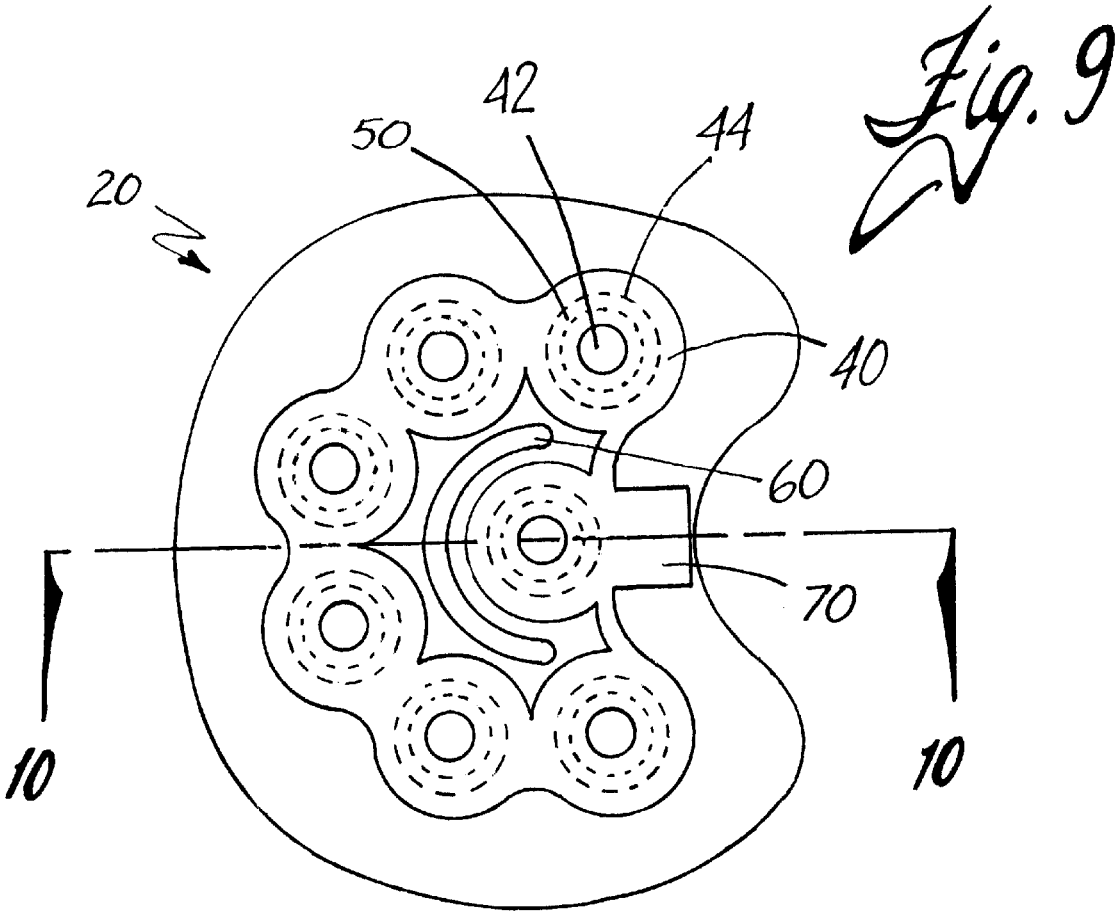
FIG. 9 is a top view of an alternative embodiment showing a U-shaped support portion and a center member.

As further shown in FIGS. 9 and 10 of the drawings, a support portion 60 may be connected between the upper portion 26 and the lower portion 22 of the encasement 20 for providing additional support. The support portion 60 can be U-shaped as best shown in FIG. 9 of the drawings, or it can consist simply of lower extrusions 24 attached to upper extrusions 28 that do not extend into a compression spring 50. The support portion provides additional support for the encasement 20 when filled with a pressurized gas or other material.

As best shown in FIG. 6 of the drawings, a lower guide member 30 is formed to fit within the side wall of the lower portion 22. The lower guide member 30 is preferably U-shaped similar to the floor of the lower portion 22. The lower guide member 30 preferably includes a plurality of lower apertures 32 that receive the lower extrusions 24.

The lower apertures 32 are preferably aligned within the outer perimeter of the lower guide member 30 as shown in FIG. 6. As further shown in FIG. 6 of the drawings, a corresponding plurality of lower spring retainers 34 are positioned within the lower apertures 32 for receiving lower section of the plurality of compression springs 50.

As best shown in FIG. 6 of the drawings, an upper guide member 40 is formed to fit within the side wall of the lower portion 22. The upper guide member 40 is preferably U-shaped similar to the upper portion 26. The upper guide member 40 preferably includes a plurality of upper apertures 42 that receive the upper extrusions 28.

The upper apertures 42 are preferably aligned within the outer perimeter of the upper guide member 40 as shown in FIG. 6. As further shown in FIG. 6 of the drawings, a corresponding plurality of upper spring retainers 44 are positioned within the upper apertures 42 for receiving upper section of the plurality of compression springs 50.

For improved performance and durability, the preferred method of assembling the device in the above indicated embodiment would include first applying a heat activated adhesive to the bottom portion of the lower guide member 30 and to the top portion of the upper guide member 40. Upon allowing the adhesive to dry, the compression springs 50 as well as a suitable connecting member 70 would then be placed into the lower spring retainers 34 of the lower guide member 30. The connecting member 70 would be fixedly attached to the lower guide member 30 by use of an adhesive or other fastening means. Additionally, in all embodiments of the invention, the compression springs 50 could also be further secured with the use of an adhesive if added strength is desired. The springs 50 and connecting member 70 would then be mated to the corresponding upper spring retainers 44 of the upper guide member 40, with the top portion of the connecting member 70 and the springs being fixedly attached to the upper guide member 40. The resilient connecting member 70 in this application would additionally contain a horizontal aperture 72 located through the central axis of its diameter to allow insertion of an air insertion nozzle used in the manufacturing process. The connecting member 70 is placed on and supported by the air insertion nozzle whereas the lower portion 22 and upper portion 26 of the encasement 20 are placed or formed around the assembly and are hermetically or chemically sealed. If desired, just prior to withdrawal of the air insertion nozzle, a pre-determined quantity of air pressure could be inserted into the cavity of the assembly through the horizontal aperture 72 in the connecting member 70. Once the nozzle is removed, final sealing of the lower portion 22 and the upper portion 26 is performed. The final assembly step would require heating the sealed assembly 10 to activate the adhesive on the lower guide member 30 and the upper guide member 40, to provide a firm connection between the components of the assembly 10, preventing unnecessary movement and separation, and affording better stability and durability of the inventive device. The assembly could then be inserted and bonded into the mid-sole 14 of a shoe in a pre-formed cut-out, or optionally, it can be molded within the mid-sole 14 during the mid-sole manufacturing process as previously detailed. While this is a preferred method of manufacturing, it is understood that a traditional bonding element could also be used to attach the guide members 30, 40 to the interior portions 22, 26 of the sealed encasement 20. Additionally, the components of the assembly 10 can be assembled entirely eliminating the use of any bonding methods.

As previously described, the lower guide member 30 and the upper guide member 40 are fixedly attached to one another by way of a resilient connecting member 70. In one embodiment as best shown in FIG. 6, the resilient connecting member 70 is a cylindrical elastic foam material, however it can be appreciated that the resilient connecting member 70 can take on various other shapes depending on the overall design of the device. In this embodiment the resilient connecting member 70 can further comprise a chamber as a means for allowing a lower extrusion 24 and upper extrusion 28 of the sealed encasement 20 to extend within the chamber of the resilient connecting member 70 where they would be adjoined.

Figure 13:
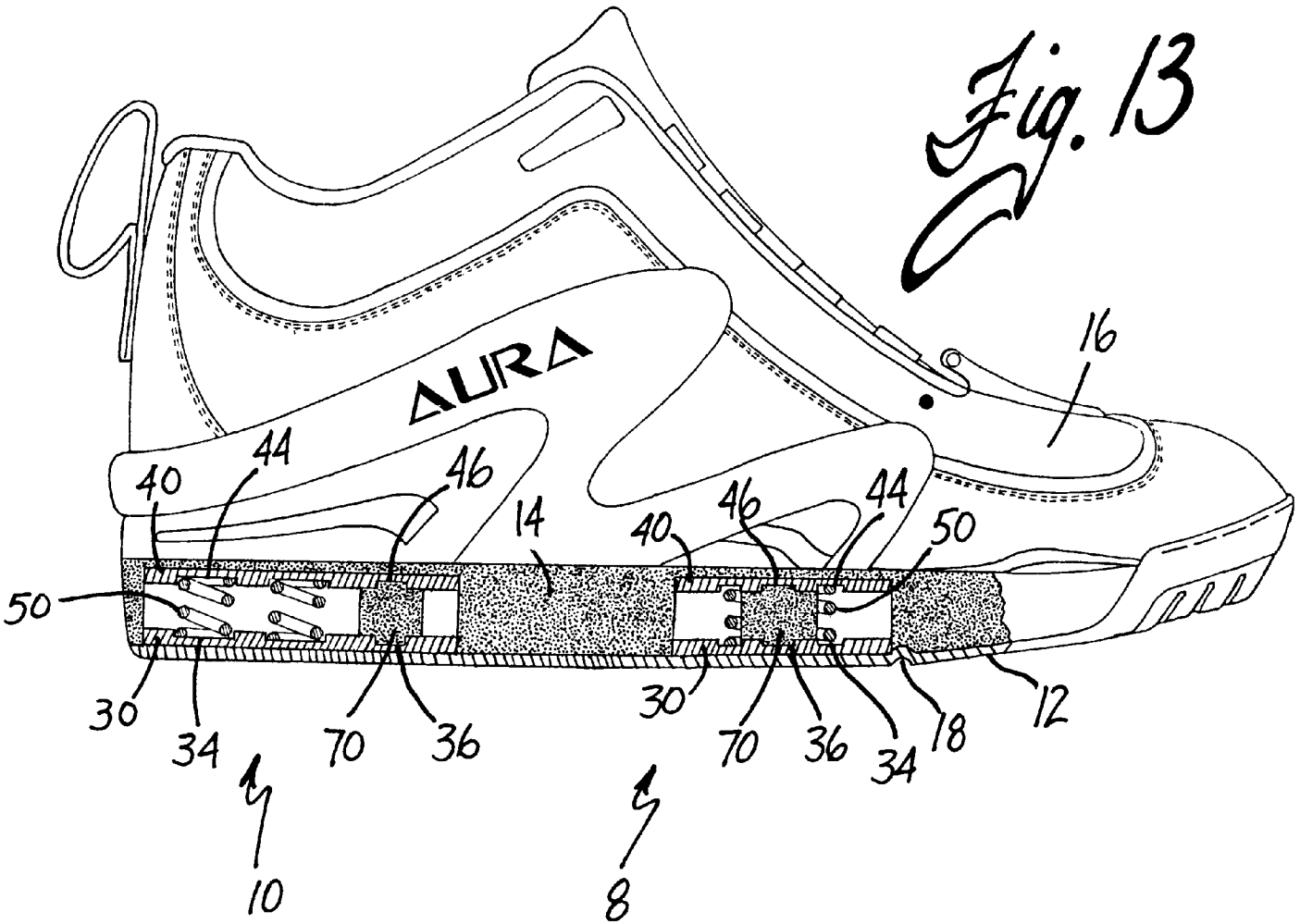
FIG. 13 is a side view of an alternative embodiment of the present invention in the forefoot of an athletic shoe showing the placement of the resilient connecting member within the interior diameter of the spring.

As best shown in FIG. 14 of the drawings, more than one resilient connecting member 70 can be used. The resilient connecting member can also be placed anywhere within the assembly 10 depending on the application of the assembly 10 and the desired performance characteristics of the footwear which it will be incorporated in. FIG. 14 additionally shows the resilient connecting member 70 placed within the interior diameter of a compression spring 50. As best shown in FIG. 13, the resilient connecting member 70 is retained by an adhesive within an optional lower connecting member retainer 36 of the lower guide member 30 and upper connecting member retainer 46 of the upper guide member 40. Alternatively, the connecting member 70 can be attached directly to the inside portions of the guide members 30, 40.

In an alternative embodiment as best illustrated in FIGS. 9 and 10, the resilient connecting member 70 is an integrally molded part of the lower guide member 30 and the upper guide member 40. In this embodiment the connecting member 70 may be of unitary construction, or it can also be comprised of a bottom portion attached to the lower guide member 30, and a top portion attached to an upper guide member 40, with both portions meeting at an axis and being fixedly attached by a bonding method. The center member 70 preferably tapers toward a pivot point, however it can be appreciated that the placement and configuration of the center member 70 can be modified depending on the desired characteristics of the inventive device. As previously illustrated, this version of the connecting member 70 could also contain a horizontal aperture 72 located through a central axis to allow insertion of an air insertion nozzle used in the manufacturing process.

The resilient connecting member 70 is primarily designed to limit the separation that can occur between the lower guide member 40 and the upper guide member 30, while simultaneously providing a means of allowing the springs 50 to compress below their uncompressed height when a force is applied on the assembly 10. As previously discussed, additional purposes for the resilient connecting member 70 include improving the manufacturing process, and for providing increased stability for the invention during use.

In a second alternative embodiment shown in FIGS. 7 and 13 of the drawings, the inventive device can be constructed without the sealed encasement 20. As shown in FIG. 7, the same structure would be utilized and retained within the heel portion of the mid-sole 14 without the sealed encasement 20 thereby decreasing the overall expense of the inventive device. FIG. 13 shoes a forefoot assembly 8. In applications where a sealed encasement 20 is not used, the resilient connecting member 70 could comprise either a solid configuration or a substantially hollow configuration. Preferred materials would consist of an elastically deformable thermoplastic or polyurethane.

Figure 4:
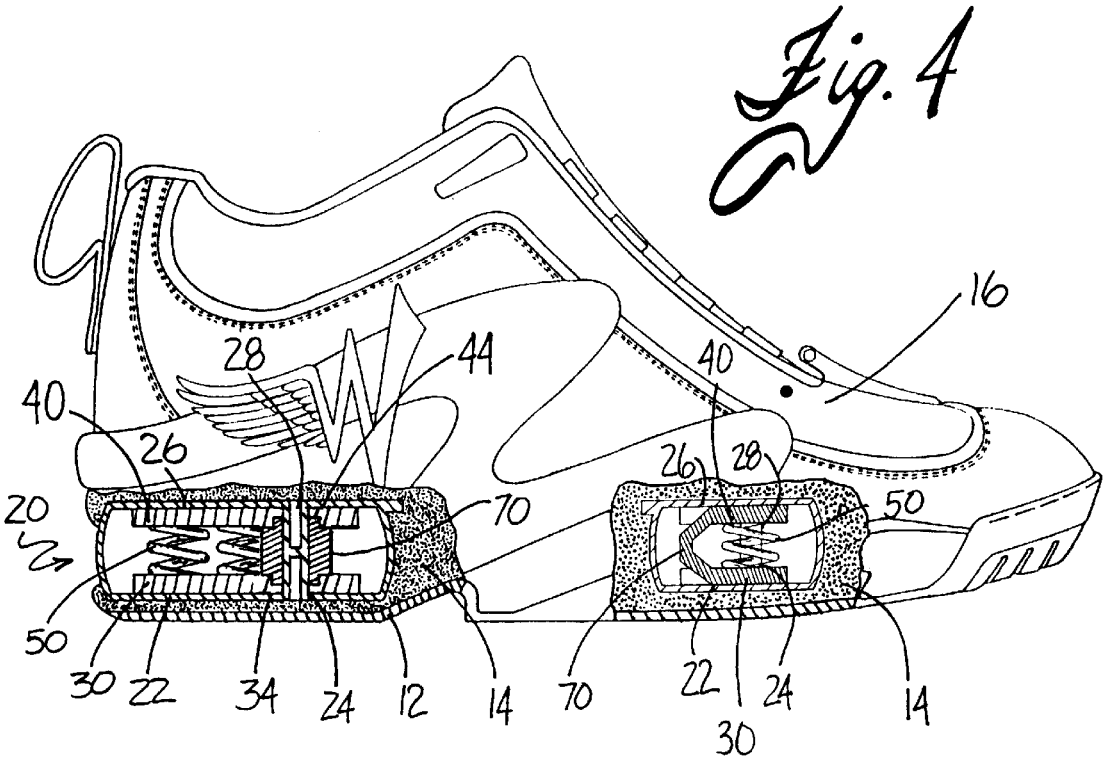
FIG. 4 is cross sectional view of the alternative embodiment taken along line 4—4 of FIG. 3, additionally showing the placement of another embodiment of the present invention in the forefoot section of a shoe.
Figure 5:
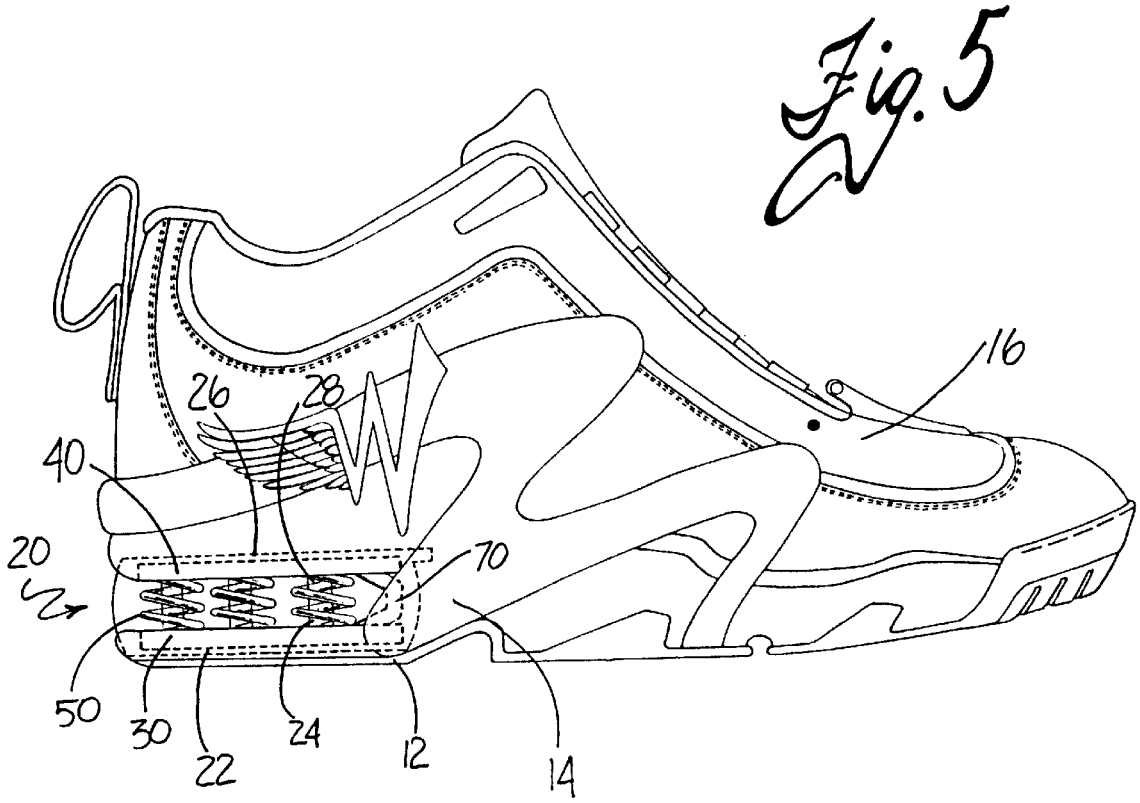
FIG. 5 is a side view of the present invention within a shoe showing another embodiment of the connecting member.

As best shown in FIGS. 1, 2, 4 and 5 of the drawings, the plurality of compression springs 50 are retained between the lower guide member 30 and the upper guide member 40. The compression springs 50 are retained within the spring retainers 34, 44 as shown in FIG. 4 of the drawings. The compression springs 50 may be constructed of any well-known material or gauge of flat or round wire, and in any configuration such as cylindrical, conical or wave type.

In another embodiment as best shown in FIGS. 14 and 15, the footwear could contain a first shock absorption and energy return assembly 8 situated toward the front of the shoe at a point below the ball of the foot and behind a flex groove 18 incorporated into the out-sole 12 and a second shock absorption and energy return assembly 10 situated at the back of the shoe at a point below the heel. The flex groove 18 is incorporated to provide a transition point whereas the out-sole 12 and mid-sole 14 will bend at a point directly in front of the forward shock absorption and energy return assembly 8, allowing the assembly 8 to more effectively absorb and return energy received during running, walking or jumping activities. In this configuration, the assemblies 8, 10 would be connected by a medial connecting shank 80 that attaches the lower guide member 30 of the forward shock absorption and energy return assembly 8 to the lower guide member 30 of the rear shock absorption and energy return assembly 10. This medial connecting shank 80 provides improved medial support and increased torsional stability. Additionally, the medial connecting shank 80 functions similar to a leaf spring, providing further performance enhancing energy return capabilities to the shoe.

A further feature of the instant invention, is the ability to tune it depending on its intended use. Specifically, the springs 50 within the assemblies 8, 10 can provide different return rates, or spring rates, depending on the desired function of the shoe. For a running shoe, where its use generally consists of a repetitive, medium impact forward motion, a shoe providing exceptional cushioning and energy return properties would be most desirable. In this case a high resiliency spring 50 with a low spring rate would be most suitable. However, as in the case of a higher impact sport such as basketball, that also requires quick lateral movements, a more stable spring 50 with a higher spring rate would be required. The higher spring rates prevent bottoming out and provide better lateral stability to the shoe. Additionally, in embodiments that incorporate a sealed encasement 20, the assembly could be further tuned at the time of manufacture by adjusting the amount of pressurized air that it will contain.

Figure 11:
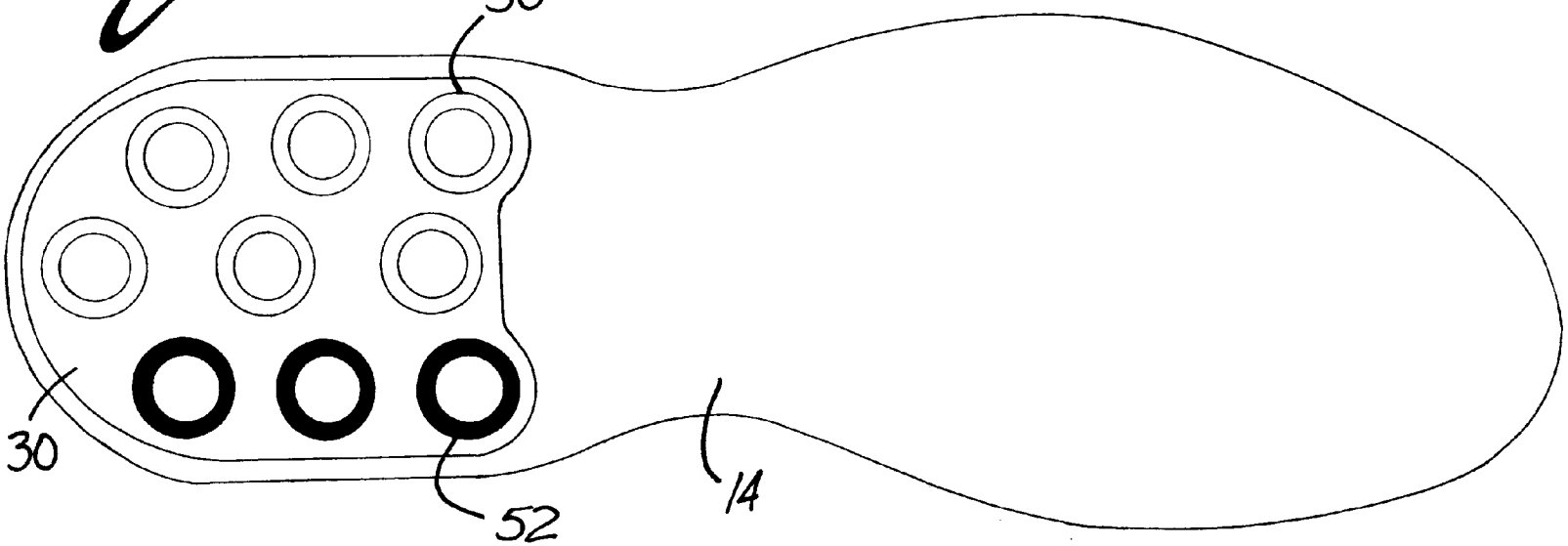
FIG. 11 is a top view of an alternative embodiment of the spring housing further showing an arrangement of springs of varying rates in order to provide a method for controlling pronation.
Figure 12:
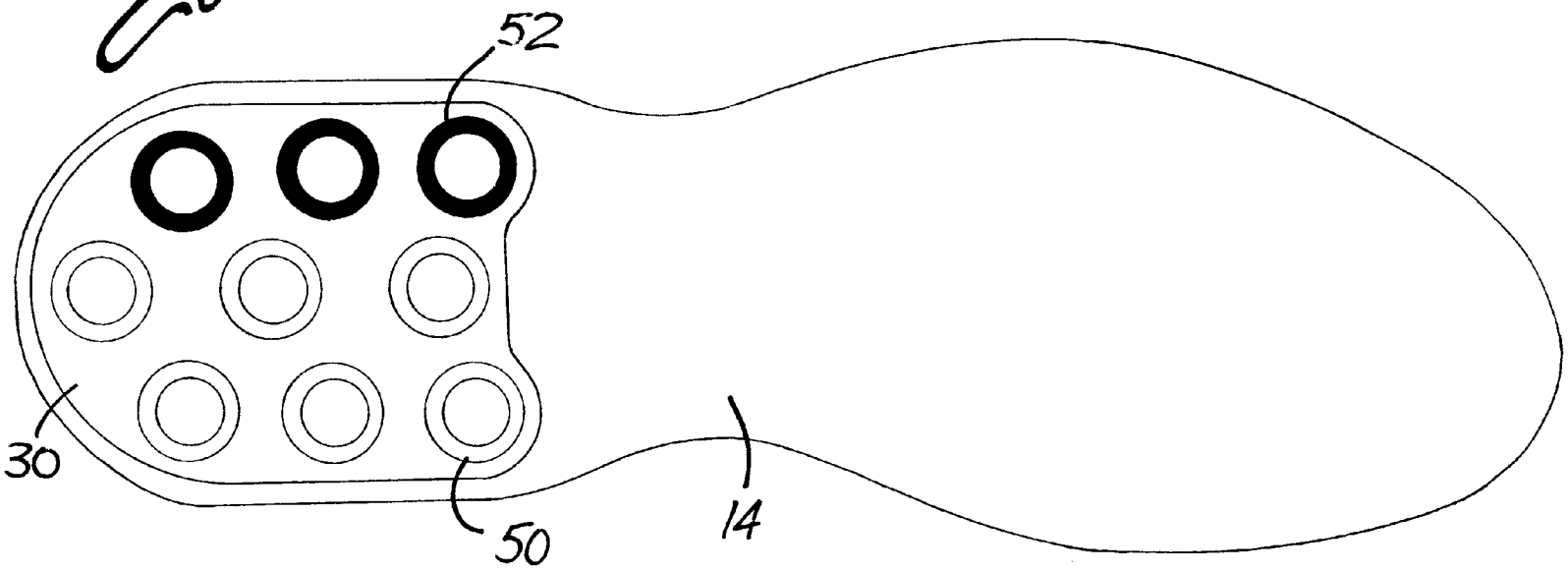
FIG. 12 is a top view of an alternative embodiment of the spring housing further showing an arrangement of springs of varying rates in order to provide a method for controlling supination.

In FIGS. 11 and 12, two specific tuning arrangements are disclosed. FIG. 11 shows how the springs 50 could be arranged to address the issue of over pronation when running. Pronation is the flattening out of the arch when the foot strikes the ground as well as the process by which you shift your weight from the outer, or lateral side of your foot to the inner, or medial side. The foot pronates to absorb shock when the heel hits the ground. Over pronation occurs when a runners ankle rolls to far inward. This condition reduces the amount of force that is produced, dramatically reducing a runners power and performance. Over pronation also subjects a runner to severe injury, since it places a great deal of stress on the ligaments and bones of the legs. By placing higher rate springs 52 at the medial portion of the shoe, and lower rate springs 50 throughout the remaining portions of the shoe, this problem can be reduced or eliminated by providing a firmer platform at the medial area thereby compensating for the over pronators tendency to roll his foot to far inward.

FIG. 11 shows how the springs 50 could be arranged to address the issue of over supination when running. Supination is the process by which you shift your weight from the medial side of your foot to the lateral side. The foot supinates to provide a more stable, rigid structure when pushing off the rear of the foot to the front of the foot. Over supination occurs when a runners ankle rolls to far outward. This condition also reduces the amount of force that is produced, reducing a runners power and performance. Over supination also subjects a runner to severe injury, since it too places a great deal of stress on the ligaments and bones of the legs. By placing higher rate springs 52 at the lateral portion of the shoe, and lower rate springs 50 throughout the remaining portions of the shoe, this problem can be reduced or eliminated by providing a firmer platform at the lateral area thereby compensating for the over supinators tendency to roll his foot to far outward.

Other specific tuning arrangements can be achieved to address under pronation, under supination, and other specific performance and orthopedic requirements, based on the footwear's intended function.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article of footwear which includes an upper, a mid-sole, and an out-sole, said footwear incorporating a shock absorption and energy return assembly comprising:

a resiliently strong lower guide member, a resiliently strong upper guide member, a plurality of springs positioned between said lower guide member and upper guide member; wherein said guide members include a plurality of spring retainer cavities for providing a more substantial means of holding said springs, wherein said spring retainer cavities each further include resilient cylindrical polyurethane connecting members that are fixedly attached to the interior portions of the upper and lower guide members and serve to limit the separation between the said lower guide member and upper guide member, preventing disengagement of the springs from within the guide members while simultaneously providing a means of allowing the said springs to compress below their uncompressed height when a force is applied on the said assembly, and said assembly is positionable within the mid-sole of said article of footwear, whereas the mid-sole is fixedly attached to the upper, and the out-sole is fixedly attached to the bottom portion of the mid-sole and the lower guide member.

2. The article of footwear incorporating a shock absorption and energy return assembly of claim 1, wherein the footwear contains a forward shock absorption and energy return assembly situated at a point beneath the ball of the foot, and a rear shock absorption and energy return assembly situated at a point beneath the heel of the foot.

3. The article of footwear incorporating a shock absorption and energy return assembly of claim 2 wherein the lower guide member of the forward shock absorption and energy return assembly is integrally attached to the lower guide member of the rear shock absorption and energy return assembly by a medial connecting member.

4. The article of footwear incorporating a shock absorption and energy return assembly of claim 1, wherein said mid-sole has one or more openings to provide a means of viewing the assembly.

5. The article of footwear incorporating a shock absorption and energy return assembly of claim 1, wherein said assembly is surrounded by a sealed transparent encasement made of a flexibly resilient material.

6. The article of footwear incorporating a shock absorption and energy return assembly of claim 5, wherein said sealed encasement contains a pressurized gas.

7. The article of footwear incorporating a shock absorption and energy return assembly of claim 1, wherein the springs positioned at a medial portion of the sagittal plane of the assembly are of a different spring rate than the springs of the lateral portion, providing for a means of pronation control to the footwear.

8. The article of footwear incorporating a shock absorption and energy return assembly of claim 1, wherein the springs positioned at a lateral portion of the sagittal plane of the assembly are of a different spring rate than the springs of the medial portion, providing for a means of supination control to the footwear.

9. An article of footwear which includes an upper, a mid-sole attached to the upper, and an out-sole, said mid-sole incorporating a shock absorption and energy return assembly comprising:

a resiliently strong lower guide member including a plurality of spring retainer cavities;

a resiliently strong upper guide member including a plurality of spring retainer cavities;

a plurality of springs positioned between said lower guide member and upper guide member, wherein said lower guide member is fixedly attached to said upper guide member by way of a resilient connecting member, and said assembly is surrounded by a resilient encasement having a lower portion and an upper portion, wherein said encasement includes a plurality of extrusions extending from said lower portion and a corresponding plurality of extrusions extending from said upper portion, wherein said lower guide member includes a plurality of apertures and said upper guide member includes a plurality of apertures, whereas said apertures receive said extrusions, wherein said extrusions extend into said plurality of springs, and said plurality of extrusions are adjoined.

10. The article of footwear incorporating a shock absorption and energy return assembly of claim 9, wherein at least one extrusion from the lower portion is connected to one extrusion of the upper portion to form a support portion.

11. The article of footwear incorporating a shock absorption and energy return assembly of claim 9, wherein there is more than one resilient connecting member.

12. The article of footwear incorporating a shock absorption and energy return assembly of claim 9, wherein the resilient connecting member is an elastically deformable element including one or more apertures, whereas one or more said extrusions extending from said lower portion, and one or more extrusions extending from said upper portion, extend into said apertures and are adjoined.

13. The article of footwear incorporating a shock absorption and energy return assembly of claim 9, wherein the resilient connecting member contains a horizontal aperture located through a central axis of its diameter to allow insertion of an air insertion nozzle used in the manufacturing process.

14. The article of footwear incorporating a shock absorption and energy return assembly of claim 9, wherein the springs positioned at a medial portion of the sagittal plane of the assembly are of a different spring rate than the springs of the lateral portion, providing for a means of pronation control to the footwear.

15. The article of footwear incorporating a shock absorption and energy return assembly of claim 9, wherein the springs positioned at a lateral portion of the sagittal plane of the assembly are of a different spring rate than the springs of the medial portion, providing for a means of supination control to the footwear.

* * * * *